US009461431B2

(12) United States Patent
Murtagian et al.

(10) Patent No.: US 9,461,431 B2
(45) Date of Patent: Oct. 4, 2016

(54) MECHANISM FOR FACILITATING AND EMPLOYING A MAGNETIC GRID ARRAY

(71) Applicant: INTEL CORPORATION, Santa Clara, CA (US)

(72) Inventors: Gregorio R. Murtagian, Phoenix, AZ (US); Bhanu Jaiswal, Chandler, AZ (US); Sriram Srinivasan, Chandler, AZ (US); Michael J. Hill, Gilbert, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/751,871

(22) Filed: Jun. 26, 2015

(65) Prior Publication Data

US 2015/0318655 A1 Nov. 5, 2015

Related U.S. Application Data

(62) Division of application No. 13/729,261, filed on Dec. 28, 2012, now Pat. No. 9,118,143.

(51) Int. Cl.

| | |
|---|---|
| ***H01R 11/30*** | (2006.01) |
| ***H01R 43/20*** | (2006.01) |
| ***H01R 13/62*** | (2006.01) |
| ***H01R 43/26*** | (2006.01) |
| ***H01R 12/73*** | (2011.01) |

(52) U.S. Cl.

CPC ..... *H01R 43/205* (2013.01); *H01R 12/73* (2013.01); *H01R 13/6205* (2013.01); *H01R 43/26* (2013.01); *Y10T 29/4913* (2015.01); *Y10T 29/49146* (2015.01); *Y10T 29/49149* (2015.01)

(58) Field of Classification Search

CPC H01R 43/205; H01R 12/73; H01R 13/6205; H01R 43/26; H01R 11/60; Y10T 29/49149; Y10T 29/49146; Y10T 29/4913

USPC ..... 439/39

See application file for complete search history.

(56) References Cited

U.S. PATENT DOCUMENTS

| | | | | |
|---|---|---|---|---|
| 2004/0099711 | A1* | 5/2004 | Liao | B23K 37/0435 228/180.5 |
| 2007/0074568 | A1* | 4/2007 | Benner | G01F 23/36 73/290 R |
| 2007/0075809 | A1 | 4/2007 | Shen et al. | |
| 2007/0107503 | A1* | 5/2007 | Benner | G01F 23/36 73/114.54 |
| 2007/0121428 | A1 | 5/2007 | Fujita et al. | |
| 2008/0068816 | A1* | 3/2008 | Han | H01R 11/30 361/760 |
| 2008/0113524 | A1 | 5/2008 | Ha et al. | |
| 2008/0124199 | A1 | 5/2008 | Hwang et al. | |
| 2008/0158301 | A1* | 7/2008 | Silverbrook | B41J 2/14 347/54 |
| 2009/0078484 | A1* | 3/2009 | Kocijan | B60L 13/04 180/167 |
| 2010/0024266 | A1 | 2/2010 | Pemberton | |
| 2010/0026920 | A1 | 2/2010 | Kim et al. | |
| 2013/0222090 | A1* | 8/2013 | Haritou | B25B 11/002 335/285 |

* cited by examiner

*Primary Examiner* — Jean F Duverne

(74) *Attorney, Agent, or Firm* — Blakely, Sokoloff, Taylor & Zafman LLP

(57) ABSTRACT

A mechanism is described for facilitating and employing a magnetic grid array according to one embodiment. A method of embodiments may include engaging, via magnetic force of a magnet, magnetic contacts of a magnetic grid array to substrate lands of a package substrate of an integrated circuit package of a computing system, and disengaging, via a removal lever, the magnetic contacts from the substrate lands.

6 Claims, 8 Drawing Sheets

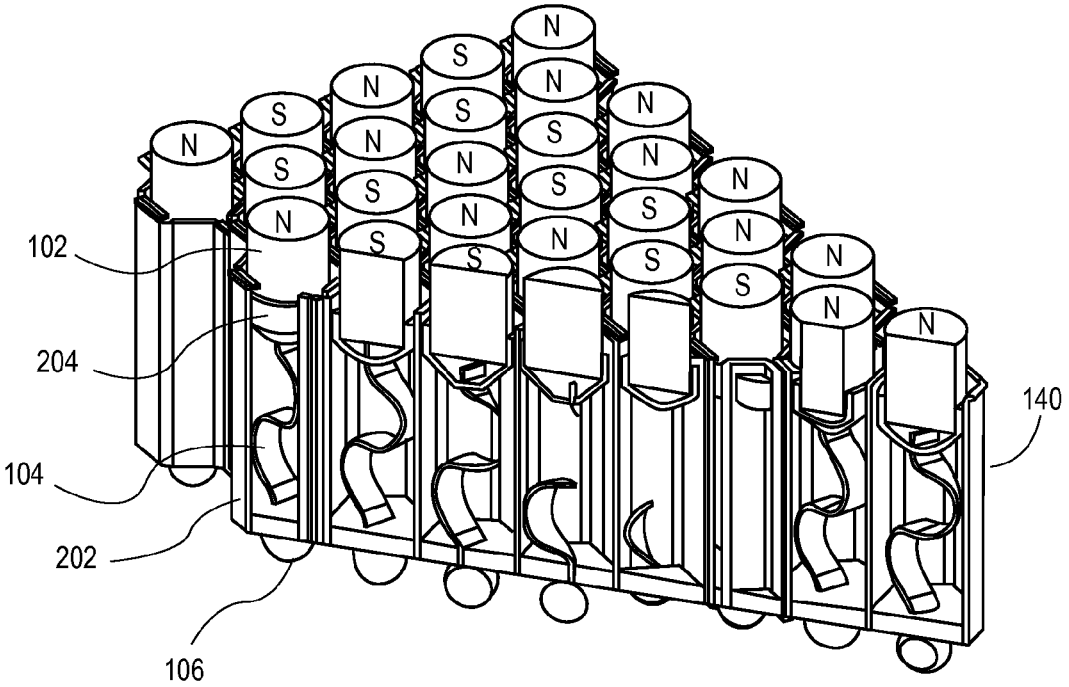
N
S
N
S
N
S

MECHANISM FOR FACILITATING AND EMPLOYING A MAGNETIC GRID ARRAY

CLAIM OF PRIORITY

This application is a divisional application of U.S. patent application Ser. No. 13/729,261, entitled "Mechanism for Facilitating and Employing a Magnetic Grid Array", by Gregorio R. Murtagian, et al., filed Dec. 28, 2012, now allowed, the benefit of and priority to which are claimed thereof and the entire contents of which are incorporated herein by reference.

FIELD

The present disclosure generally relates to electronic devices, and more particularly, to employing a magnetic grid array.

BACKGROUND

Conventional socket technologies require cumbersome loading and removal mechanisms. Many conventional socket technologies require scaling loading mechanism solutions with pin count, such as Land Grid Array (LGA) packages require complex loading mechanisms, such as Direct Socket Loading (DSL), Independent Loading Mechanism (ILM), etc. Similarly, Pin Grid Array (PGA) typically requires cambox and camplate redesigns, etc. With such mechanisms, sockets contacts often get damaged when installing and/or removing the package, while the package top side needs a keep-out zone to allow for the loading mechanism to work.

BRIEF DESCRIPTION OF THE DRAWINGS

FIG. 2E illustrates a cross-sectional view of a magnetic grid array of FIG. 2D according to one embodiment.

DETAILED DESCRIPTION

In the following description, numerous specific details are set forth in order to provide a thorough understanding of various embodiments. However, various embodiments may be practiced without the specific details. In other instances, well-known methods, procedures, components, and circuits have not been described in detail so as not to obscure the particular embodiments.

Reference in the specification to "one embodiment" or "an embodiment" means that a particular feature, structure, or characteristic described in connection with the embodiment may be included in at least an implementation. The appearances of the phrase "in one embodiment" in various places in the specification may or may not be all referring to the same embodiment.

Embodiments provide a magnetic grid array including magnet-based socket contact elements that are self-enabled by approaching of surfaces or lands (such as iron land ("Fe" or "ferrum"), etc.) attached to the package without having the need for an external loading mechanism. It is contemplated that in some embodiments, the lands may be made with hard magnetic material or soft magnetic material, as will be further described below. Terms like "land" and "surface" may be used interchangeably throughout this document. Embodiments provide for a magnetic grid array that may be used without any bent contacts or requiring a loading mechanism. Further, magnetic grid array provides for an improved system assembly (e.g., package drop-in, self-enabling, tool-less simplified removal lever, etc.) and package design flexibility (e.g., pin density may be at 40 mil, enabled stack-ups, package bottom may be used as a reference plane, socket enabling insensitive to system stiffness, no load may be applied to packaged and no requirement may be placed on heat sink enabling load, no need for a non-pedestal heat sink solution, etc.).

Figure 1A:
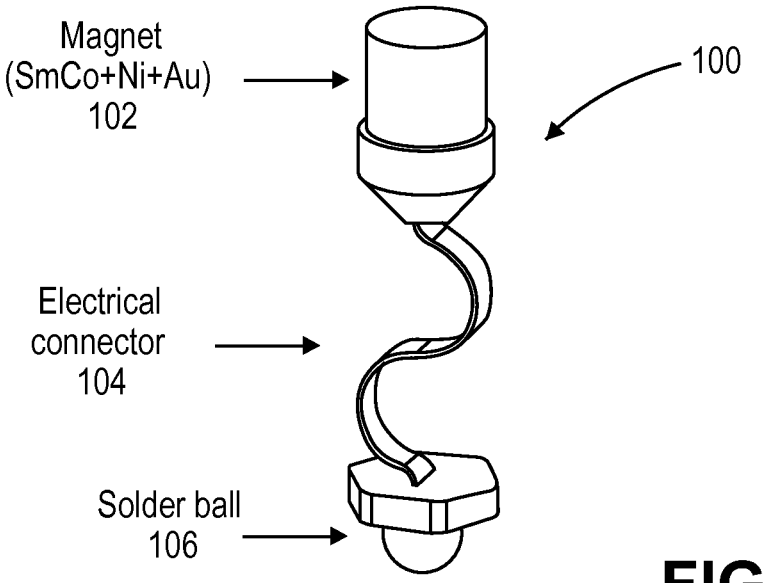
FIG. 1A illustrates a single magnetic contact according to one embodiment.

FIG. 1A illustrates a single magnetic grid contact 100 according to one embodiment. The illustrated single magnetic element or contact ("contact") 100 includes various components, such as a magnet 102, an electrical connector 104, a solder ball 106, while a selective plating (e.g., nickel ("Ni")/gold ("Au") plating, etc.) may be applied over the magnet 102. Magnet 102 may include any type of hard or soft magnet, such as a Samarium-Cobalt (SmCo)-based magnet, etc., having a plating, such as the aforementioned Ni/Au plating. It is contemplated that although solder ball 106 may be used for attachment to a motherboard, in some embodiments, signal contact 100 may include a magnet on the other side as well, such as having two magnets instead. Other similar arrangements and/or changes may be made to single contact 100.

In one embodiment, single contact 100 may include a surface mount technology (SMT)-type socket that uses magnetic attraction as contact-enabling force. Each contact may contain a small magnet and ferromagnetic material on the package interface. Package installation may need the package to be close enough to the contacts where the magnetic force goes into effect and facilitates the contact. With regard to removal, a tool-less lever may be used to remove the package as will be further described in this document.

Figure 1B:
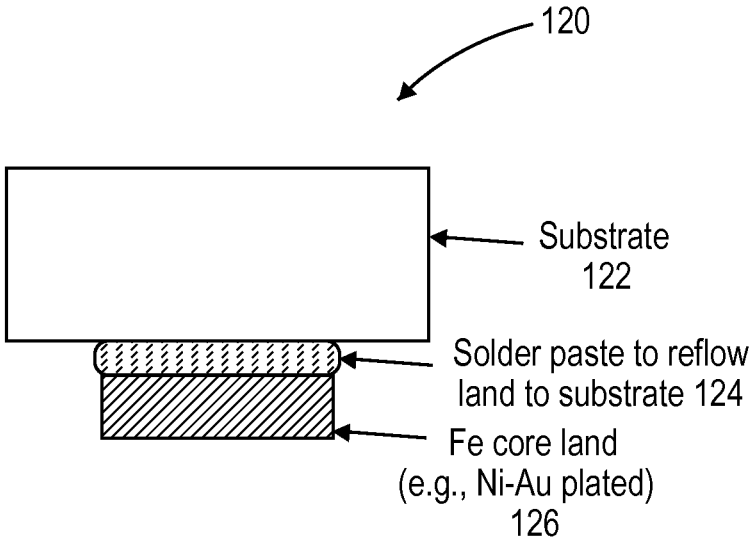
FIG. 1B illustrates a dead bug view of a single substrate land of a substrate package of an integrated circuit package at a computing system according to one embodiment.

FIG. 1B illustrates a dead bug view of a single substrate land 120 of a substrate package of an integrated circuit (IC) package at a computing system according to one embodiment. As illustrated, a Ni—Au-plated Fe surface or land 126 may be used and reflowed into substrate 122 using solder paste 124. It is contemplated that magnet 102 of single contact 100 and any magnet associated with Fe core land 126 may be soft magnet or hard magnet.

Figure 1C:
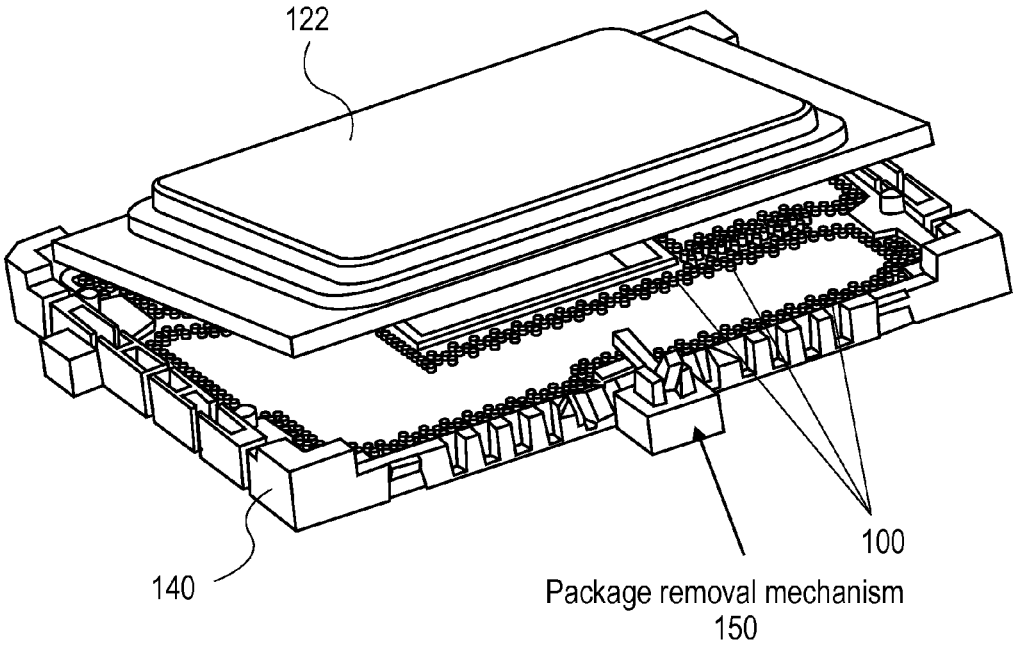
FIG. 1C illustrates a magnetic grid array according to one embodiment.

FIG. 1C illustrates a magnetic grid array 140 according to one embodiment. A magnetic grid array system may provide magnetic grid array 140 having any number of single contacts 100 and a mechanism 150 for installation and removal of any number of single contacts 100 at magnetic grid array 140. For example, the installation of single contacts 100 may include connecting or touching or engaging Ni—Au-plated Fe surface/land 126 of substrate 122 with Ni—Au-plated magnet 102 of single contact 100. Package removal mechanism 150 may further include a package removal lever 152 to disengage substrate 126 from single contacts 100 of magnetic grid array 140

Figure 1D:
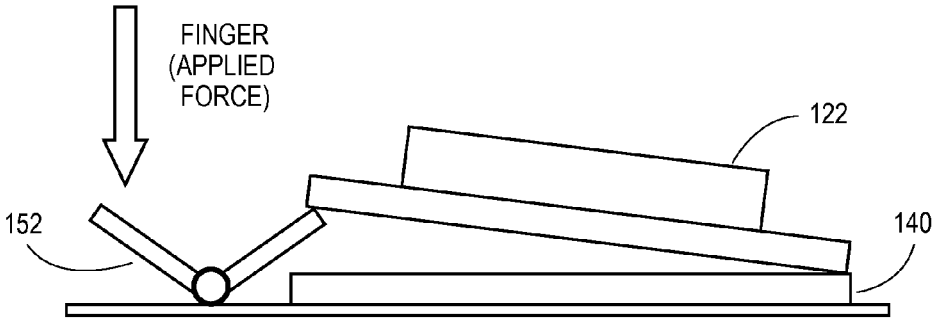
FIG. 1D illustrates a package removal lever of a package removal mechanism according to one embodiment.

FIG. 1D illustrates a package removal lever 152 of a package removal mechanism 150 according to one embodiment. In the illustrated embodiment, lever 152 may be placed between magnetic grid array 140 and substrate 122 to separate the Ni—Au-plated surface of magnet 102 of single contact 100 from that of the Ni—Au-plated surface of Fe surface 124. For example, as illustrated, a sufficient amount of force may be applied (such as by a human finger, a device, etc.) to free edge/end of lever 152 so that the other edge/end that is placed below a portion of substrate 126 may be used to sufficiently lift substrate 122 away from magnetic grid array 140 to achieve the aforementioned disengagement of magnet 102 from Fe surface 124, where the lifting follows lever actuation of lever 152. In contrast, the force may be released to allow substrate 122 to be sufficiently lowered so an engagement of Fe surface 124 and magnet 102 may be achieved, where the lowering follows lever actuation of lever 152. Although lever 152 is not limited to a particular type or material, an example of such lever 152 may include a push lever similar to the one used with memory cards.

Figure 2A:
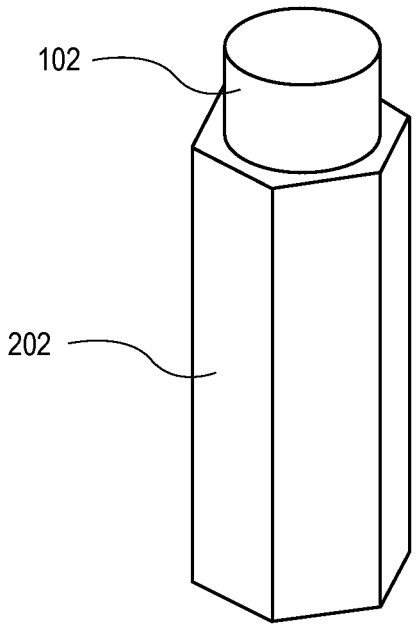
FIG. 2A illustrates a single housing shell of a magnetic grid array according to one embodiment.

FIG. 2A illustrates a single housing shell 202 of a magnetic grid array 140 according to one embodiment. Single housing shell or casing 202 is illustrated as having employed a single substrate contact 100 as shown by magnet 102 being slightly out of shell 202 that provides both the housing and insulation for a single substrate contact 100 of FIG. 1A.

Figure 2B:
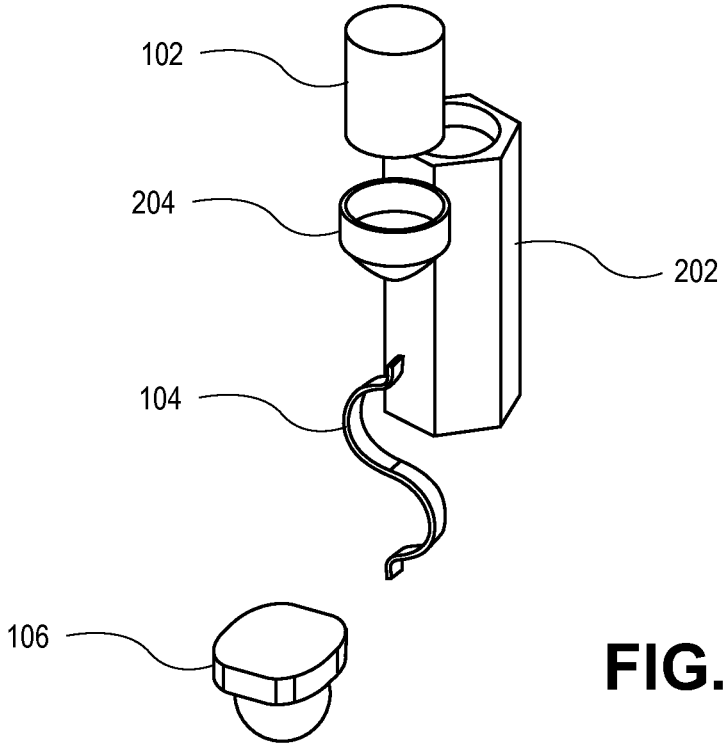
FIG. 2B illustrates an exploded view of single housing shell of FIG. 2A according to one embodiment.

FIG. 2B illustrates an exploded view of single housing shell 202 of FIG. 2A according to one embodiment. The illustrated an exploded or unassembled view of shell 202 shows shell 202 including a cup 204 to retain magnet 102 of single contact 100 of FIG. 1A by interfering with housing lip. The material of which cup 204 may be made of is not limited to a particular type or form of material, but as an example, cup 204 may be made of silicon injection molding or stamped metal. In one embodiment, electrical connector 104 (that is electrically and mechanically connected to magnet 102) may run through the bottom of cup 204 where it may be connected to solder ball 106. Although single contact 100 and its various parts (such as magnet 102, electrical connector 104, etc.) and shell 202 and its parts (such as cup 204, etc.) may not be limited to particular specifications, but for example and in some embodiments, electrical connector stiffness may be approximately 4 gf/mm, bulk resistance may be less than 10 mOhm, electrical connector displacement range may be +−250 um, and socket height may be approximately 3.4 mm.

Figure 2C:
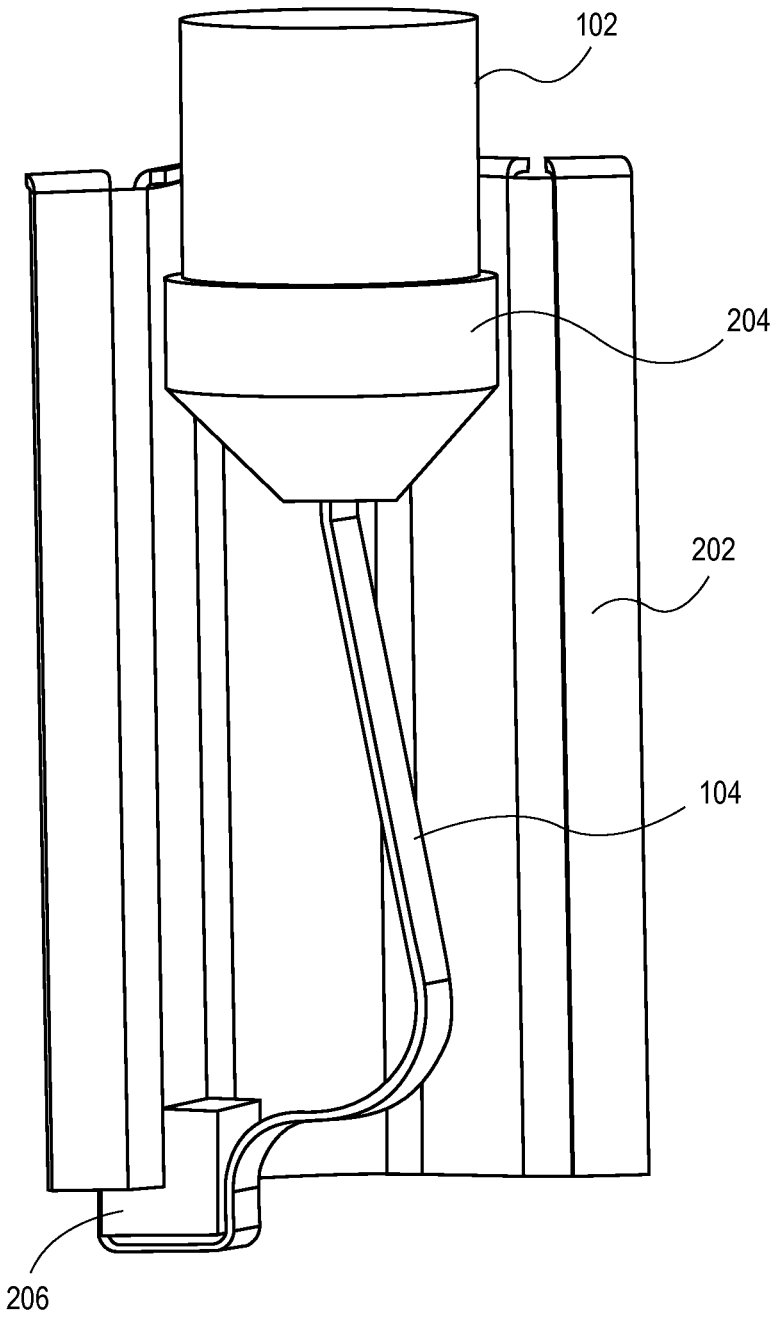
FIG. 2C illustrates a connection contact according to one embodiment.

FIG. 2C illustrates a connection contact 206 according to one embodiment. In one embodiment, electrical connector 104 may be connected to a portion of shell 202 using connection contact 206 such that connection contact 206 may facilitate mechanical and electrical support. In one embodiment, connection contact 206 may include and/or facilitate a signal contact or a ground contact. Further, in one embodiment, connection contact 206 may provide mechanical support through a component, such as a housing clip to properly clip electrical connector 104 to shell 202. As aforementioned, electrical connector 106 connects to magnet 102, such as via solder, passes through cup 204, and then connects to connection contact 206 provided by shell 202, and from there on connects to a board, such as by a solder ball and reflow (SMT).

Figure 2D:
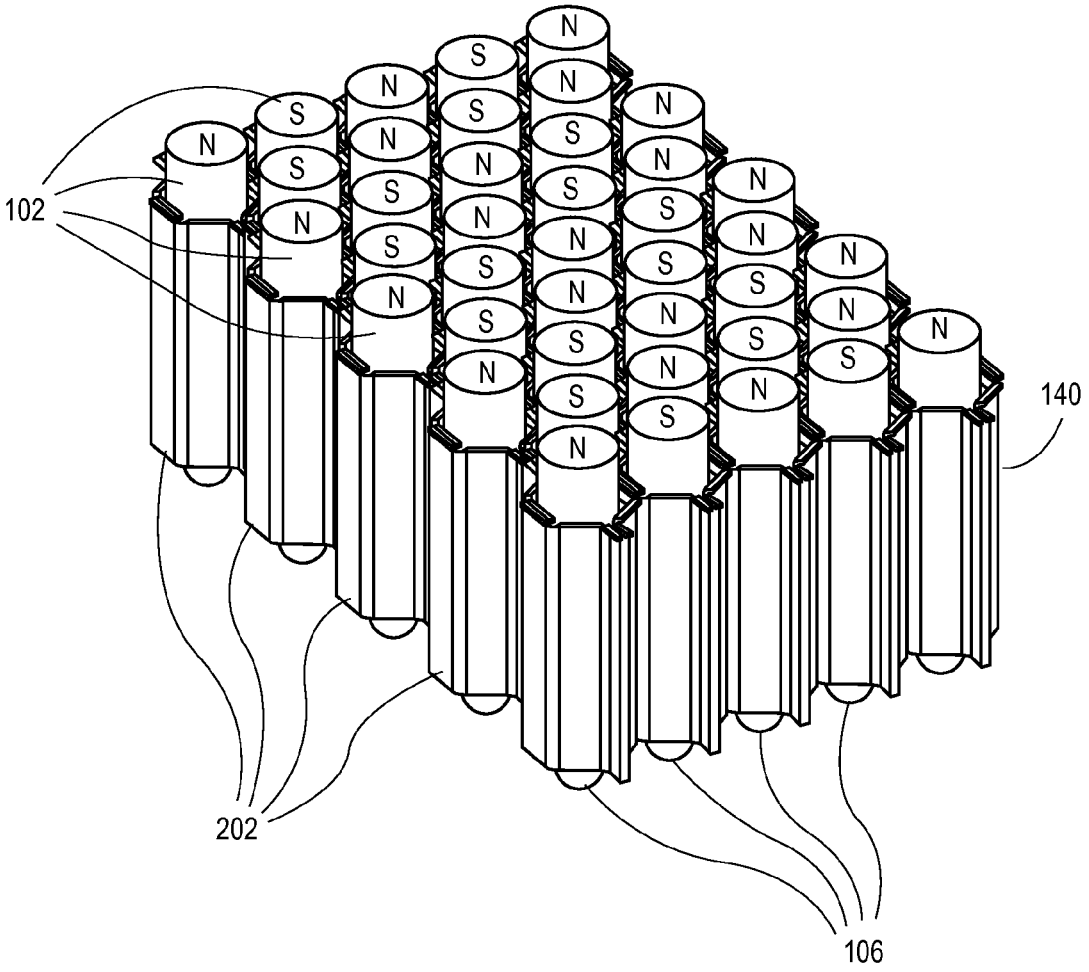
FIG. 2D illustrates a magnetic grid array according to one embodiment.

FIG. 2D illustrates a magnetic grid array 140 according to one embodiment. In the illustrated embodiment, magnetic grid array 140 includes a number of shells, such as shells 202, having single contacts, like single contacts 100 of FIG. 1A, illustrated here by their magnets 102 and solder balls 106. It is to be noted an alternate polarity arrangement (e.g., North ("N"), South ("S"), N, S, N, S, and so on) as shown to be assigned to magnets 102 provides a higher engagement force and thus a relatively more stable connection between the single contacts (such as single contacts 100 of FIG. 1A) of magnetic grid array 140 and their corresponding single surfaces/lands and the substrate (such as single surfaces 126 of substrate 122 as shown in FIG. 1B).

FIG. 2E illustrates a cross-sectional view of magnetic grid array 140 of FIG. 2D according to one embodiment. In the illustrated embodiment, shell 202 is cut and exposed, showing single contact 100 of FIG. 1A by illustrating its magnet 102 (placed in cup 204 of shell 202), electrical connector 104, and solder ball 106.

Figure 3:
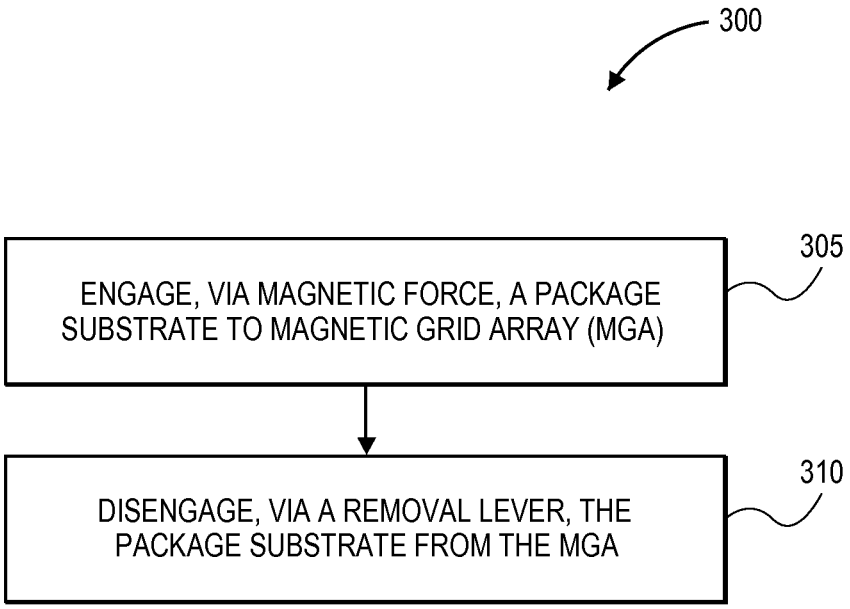
FIG. 3 illustrates a method for facilitating the use of magnetic grid array according to one embodiment.

FIG. 3 illustrates a method 300 for facilitating the use of magnetic grid array according to one embodiment. Method 300 begins at block 305 with engaging, via magnetic force, a package substrate to the magnetic grid array. As discussed throughout this document, the magnetic force may be provided by the various magnets of MGAs that are then engaged with the Fe lands of the package substrate. At block 310, the package substrate is disengaged from single contacts using a package removal lever.

Figure 4:
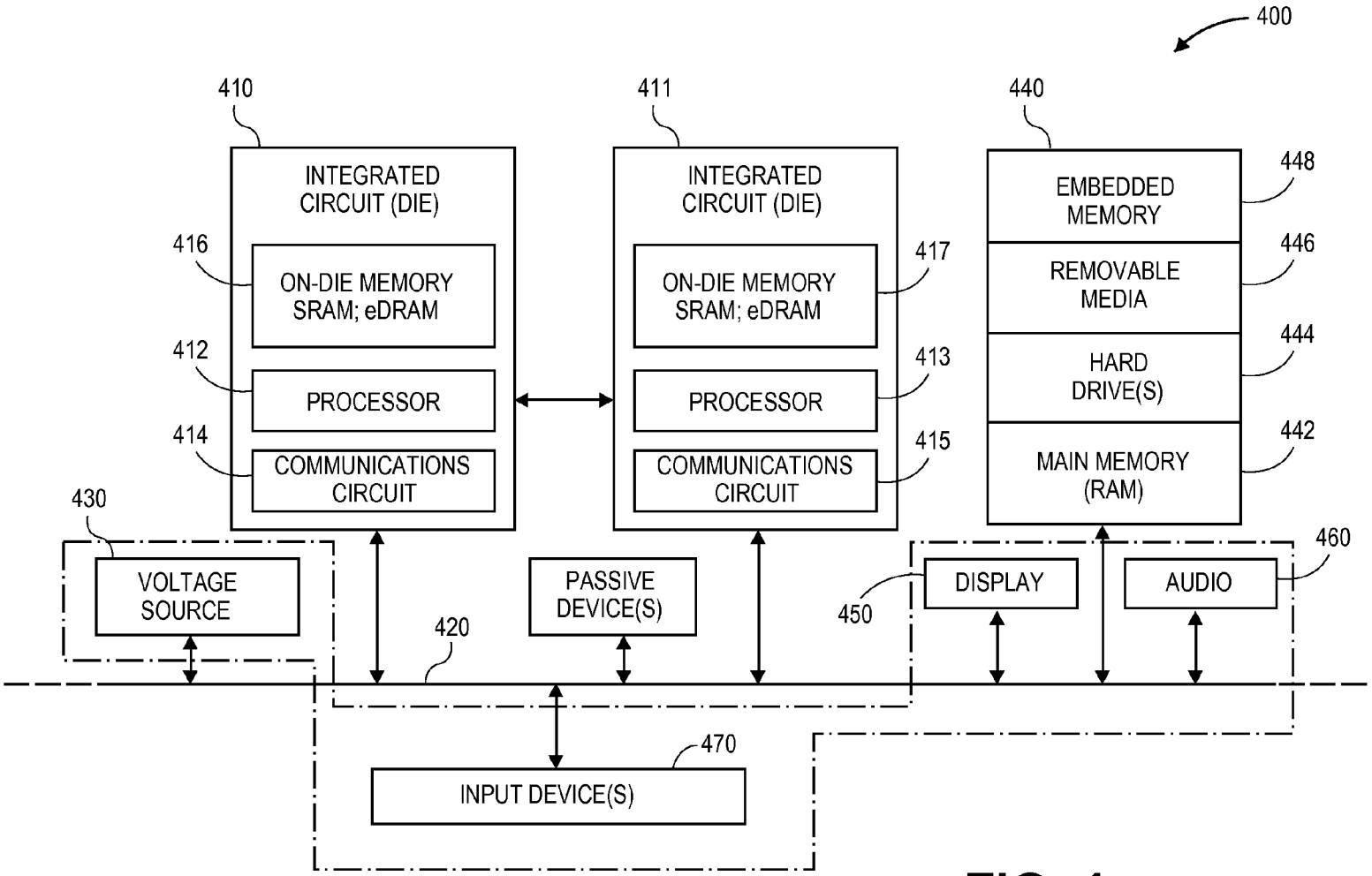
FIG. 4 illustrates one embodiment of a computer system.

FIG. 4 illustrates one embodiment of a computer system 400. The computer system 400 (also referred to as the electronic system 400) as depicted can embody a magnetic grid array, such as magnetic grid array 140 of FIGS. 1C, 2D and 2E. The computer system 400 may be a mobile device such as a netbook computer. The computer system 400 may be a mobile device such as a wireless smart phone. The computer system 400 may be a desktop computer. The computer system 400 may be a hand-held reader. The computer system 400 may be a server system. The computer system 400 may be a supercomputer or high-performance computing system.

In an embodiment, the electronic system 400 is a computer system that includes a system bus 420 to electrically couple the various components of the electronic system 400. The system bus 420 is a single bus or any combination of busses according to various embodiments. The electronic system 400 includes a voltage source 430 that provides power to the integrated circuit 410. In some embodiments, the voltage source 430 supplies current to the integrated circuit 410 through the system bus 420.

The integrated circuit 410 is electrically coupled to the system bus 420 and includes any circuit, or combination of circuits according to an embodiment. In an embodiment, the integrated circuit 410 includes a processor 412 that can be of any type. As used herein, the processor 412 may mean any type of circuit such as, but not limited to, a microprocessor, a microcontroller, a graphics processor, a digital signal processor, or another processor. In an embodiment, the processor 412 includes a thermal controller having a thermal control interface to receive test data from an automated test equipment (ATE) system and dynamically adjust a target setpoint temperature based on the data and a dynamic thermal controller to receive the target setpoint temperature from the thermal control interface and control a thermal actuator based on the target setpoint temperature as disclosed herein.

In an embodiment, SRAM embodiments are found in memory caches of the processor. Other types of circuits that can be included in the integrated circuit 410 are a custom circuit or an application-specific integrated circuit (ASIC), such as a communications circuit 414 for use in wireless devices such as cellular telephones, smart phones, pagers, portable computers, two-way radios, and similar electronic systems, or a communications circuit for servers. In an embodiment, the integrated circuit 410 includes on-die memory 416 such as static random-access memory (SRAM). In an embodiment, the integrated circuit 410 includes embedded on-die memory 416 such as embedded dynamic random-access memory (eDRAM).

In an embodiment, the integrated circuit 410 is complemented with a subsequent integrated circuit 411. Useful embodiments include a dual processor 413 and a dual communications circuit 415 and dual on-die memory 417 such as SRAM. In an embodiment, the dual integrated circuit 410 includes embedded on-die memory 417 such as eDRAM.

In an embodiment, the electronic system 400 also includes an external memory 440 that in turn may include one or more memory elements suitable to the particular application, such as a main memory 442 in the form of RAM, one or more hard drives 444, and/or one or more drives that handle removable media 446, such as diskettes, compact disks (CDs), digital variable disks (DVDs), flash memory drives, and other removable media known in the art. The external memory 440 may also be embedded memory 448 such as the first die in an embedded TSV die stack, according to an embodiment.

In an embodiment, the electronic system 400 also includes a display device 450, an audio output 460. In an embodiment, the electronic system 400 includes an input device such as a controller 470 that may be a keyboard, mouse, trackball, game controller, microphone, voice-recognition device, or any other input device that inputs information into the electronic system 400. In an embodiment, an input device 470 is a camera. In an embodiment, an input device 470 is a digital sound recorder. In an embodiment, an input device 470 is a camera and a digital sound recorder.

As shown herein, the integrated circuit 410 can be implemented in a number of different embodiments, including a test system that includes a dynamic electro-mechanical interconnect having a cavity for separating, via the cavity, a first conductor of an interconnect from a second conductor of the interconnect, and isolating, via the cavity serving as a buffer, a first electrical path provided through the first conductor from a second electrical path provided through the second conductor. The elements, materials, geometries, dimensions, and sequence of operations can all be varied to suit particular I/O coupling requirements including array contact count, array contact configuration for a microelectronic die embedded in a processor mounting substrate according to any of the several disclosed semiconductor die packaged with a thermal interface unit and their equivalents. A foundation substrate may be included, as represented by the dashed line of FIG. 4. Passive devices may also be included, as is also depicted in FIG. 4.

Although embodiments have been described in language specific to structural features and/or methodological acts, it is to be understood that claimed subject matter may not be limited to the specific features or acts described. Rather, the specific features and acts are disclosed as sample forms of implementing the claimed subject matter.

As used in the claims, unless otherwise specified the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The following clauses and/or examples pertain to further embodiments or examples. Specifics in the examples may be used anywhere in one or more embodiments. The various features of the different embodiments or examples may be variously combined with some features included and others excluded to suit a variety of different applications. Some embodiments pertain to a method comprising: engaging, via magnetic force of a magnet, magnetic contacts of a magnetic grid array to substrate lands of a package substrate of an integrated circuit package of a computing system; and disengaging, via a removal lever, the magnetic contacts from the substrate lands.

Embodiments or examples include any of the above methods wherein magnetic surface of the substrate lands is directly engaged with magnetic surface of the magnetic contacts.

Embodiments or examples include any of the above methods wherein each magnetic contact is placed within a housing shell of a plurality of housing shells of the magnetic grid array, wherein a magnet is placed within a cup of the shell.

Embodiments or examples include any of the above methods wherein the magnetic contact further comprises an electrical connector leading from an end of the magnet to an end of the shell.

Embodiments or examples include any of the above methods wherein the magnetic contact further comprises a solder ball extending from one end of the shell, wherein the magnet extends from another end of the shell.

Embodiments or examples include any of the above methods wherein each magnetic contact is disengaged from each corresponding substrate land via a removal lever, wherein sufficient force is applied to the lever to lift the package substrate to disengage it from the magnetic grid array.

In another embodiment or example, an apparatus comprises: a magnetic grid array having magnetic contacts, wherein each magnetic contact includes at least one magnet; and a package substrate of a computing system, the package substrate having substrate lands to be engaged with the magnetic contacts, wherein one or more substrate lands are engaged, via magnetic force, with one or more corresponding magnetic contacts.

Embodiments or examples include the apparatus above wherein magnetic surface of the substrate lands is directly engaged with magnetic surface of the magnetic contacts.

Embodiments or examples include the apparatus above wherein each magnetic contact is placed within a housing shell of a plurality of housing shells of the magnetic grid array, wherein a magnet is placed within a cup of the shell.

Embodiments or examples include the apparatus above wherein the magnetic contact further comprises an electrical connector leading from an end of the magnet to an end of the shell.

Embodiments or examples include the apparatus above wherein the magnetic contact further comprises a solder ball extending from one end of the shell, wherein the magnet extends from another end of the shell.

Embodiments or examples include the apparatus above wherein each magnetic contact is disengaged from each corresponding substrate land via a removal lever, wherein sufficient force is applied to the lever to lift the package substrate to disengage it from the magnetic grid array.

In another embodiment or example, a system comprises: a computing system having a magnetic grid array having magnetic contacts, wherein each magnetic contact includes at least one magnet; and a package substrate of a computing system, the package substrate having substrate lands to be engaged with the magnetic contacts, wherein one or more substrate lands are engaged, via magnetic force, with one or more corresponding magnetic contacts.

Embodiments or examples include the system above wherein magnetic surface of the substrate lands is directly engaged with magnetic surface of the magnetic contacts.

Embodiments or examples include the system above wherein each magnetic contact is placed within a housing shell of a plurality of housing shells of the magnetic grid array, wherein a magnet is placed within a cup of the shell.

Embodiments or examples include the system above wherein the magnetic contact further comprises an electrical connector leading from an end of the magnet to an end of the shell.

Embodiments or examples include the system above wherein the magnetic contact further comprises a solder ball extending from one end of the shell, wherein the magnet extends from another end of the shell.

Embodiments or examples include the system above wherein each magnetic contact is disengaged from each corresponding substrate land via a removal lever, wherein sufficient force is applied to the lever to lift the package substrate to disengage it from the magnetic grid array.

Another embodiment or example includes an apparatus performing any of the methods in the examples above In another embodiment or example, an apparatus comprises means for performing any one or more of the operations mentioned above.

In yet another embodiment or example, at least one machine-readable medium comprising a plurality of instructions that in response to being executed on a computing device, causes the computing device to carry out a method according to any one or more of the operations mentioned above.

In yet another embodiment or example, at least one non-transitory or tangible machine-readable comprising a plurality of instructions that in response to being executed on a computing device, causes the computing device to carry out a method according to any one or more of the operations mentioned above.

In yet another embodiment or example, a computing device arranged to perform a method according to any one or more of the operations mentioned above.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

What is claimed is:

1. A method comprising:

engaging, via magnetic force of one or more magnets, magnetic contacts of a magnetic grid array to substrate lands of a package substrate of an integrated circuit package of a computing system, wherein each magnetic contact includes at least one of the one or more magnets and is placed within a housing shell of a plurality of housing shells of the magnetic grid array; and disengaging, via a removal lever, the magnetic contacts from the substrate lands.

2. The method of claim 1, wherein magnetic surface of the substrate lands is directly engaged with magnetic surface of the magnetic contacts.

3. The method of claim 1, wherein a magnet is placed within a cup of the housing shell.

4. The method of claim 3, wherein the magnetic contact further comprises an electrical connector leading from an end of the magnet to an end of the shell.

5. The method of claim 4, wherein the magnetic contact further comprises a solder ball extending from one end of the shell, wherein the magnet extends from another end of the shell.

6. The method of claim 1, wherein disengaging comprises applying sufficient force to the removal lever to lift the package substrate to disengage it from the substrate lands.

* * * * *